US011688317B2

(12) United States Patent
Chen et al.

(10) Patent No.: US 11,688,317 B2
(45) Date of Patent: Jun. 27, 2023

(54) DRIVING METHOD AND DRIVING DEVICE FOR DISPLAY PANEL AND DISPLAY DEVICE

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Shuai Chen, Beijing (CN); Zhi Zhang, Beijing (CN); Xiuzhu Tang, Beijing (CN); Chun Luo, Beijing (CN); Jinjin Chen, Beijing (CN)

(73) Assignees: CHONGQING BOE OPTOELECTRONICS TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 494 days.

(21) Appl. No.: 16/978,754

(22) PCT Filed: Nov. 5, 2019

(86) PCT No.: PCT/CN2019/115567
§ 371 (c)(1),
(2) Date: Sep. 7, 2020

(87) PCT Pub. No.: WO2021/087721
PCT Pub. Date: May 14, 2021

(65) Prior Publication Data
US 2023/0124102 A1 Apr. 20, 2023

(51) Int. Cl.
*G09G 3/20* (2006.01)

(52) U.S. Cl.
CPC ..... *G09G 3/20* (2013.01); *G09G 2310/0297* (2013.01); *G09G 2310/08* (2013.01); *G09G 2330/021* (2013.01)

(58) Field of Classification Search
CPC ..... G09G 3/20; G09G 2310/0297; G09G 2310/08; G09G 2330/021
See application file for complete search history.

(56) References Cited

U.S. PATENT DOCUMENTS

2015/0145842 A1 5/2015 Maeda et al.
2019/0088185 A1 3/2019 Zhang et al.
(Continued)

FOREIGN PATENT DOCUMENTS

CN 1598917 A 3/2005
CN 101430851 A 5/2009
(Continued)

OTHER PUBLICATIONS

China Patent Office, CN201980002284.9 First Office Action dated Apr. 26, 2022.

*Primary Examiner* — Sejoon Ahn
(74) *Attorney, Agent, or Firm* — Houtteman Law LLC

(57) ABSTRACT

A driving method and a driving device for a display panel and a display device are provided. The display panel includes data line groups and multiplexers, each data line group includes at least three data lines, each multiplexer successively couples the input terminal thereof to the data lines electrically in the data line group in each line scanning period; and for at least one data line group, the driving method includes: acquiring data voltages to be output to the data lines in the data line group in a current line scanning period; in response to that the data voltages are not completely equal to each other, successively outputting the data voltages to the input terminal of the multiplexer correspond-
(Continued)

ing to the data line group, and controlling the multiplexer to electrically couple the input terminal thereof to the data line to receive the data voltages.

15 Claims, 6 Drawing Sheets

(56) References Cited

U.S. PATENT DOCUMENTS

| | | | | |
|---|---|---|---|---|
| 2020/0286420 | A1* | 9/2020 | Bai | G11C 19/28 |
| 2020/0286922 | A1* | 9/2020 | Huang | H05K 1/189 |

FOREIGN PATENT DOCUMENTS

| | | | |
|---|---|---|---|
| CN | 104575440 | A | 4/2015 |
| CN | 104933997 | A | 9/2015 |
| CN | 105047157 | A | 11/2015 |
| CN | 105047166 | A | 11/2015 |
| CN | 105869594 | A | 8/2016 |
| CN | 106847219 | A | 6/2017 |
| CN | 108335663 | A | 7/2018 |
| CN | 108877641 | A | 11/2018 |
| JP | H 08334743 | A | 12/1996 |

* cited by examiner

DRIVING METHOD AND DRIVING DEVICE FOR DISPLAY PANEL AND DISPLAY DEVICE

TECHNICAL FIELD

The present disclosure relates to the field of display technology, and in particular, to a driving method and a driving device for a display panel, and a display device.

BACKGROUND

When an image is displayed by a display device, a data voltage is output to a pixel unit by a data driving chip through a data line. In order to reduce a number of pins of the data driving chip, a multiplexer (MUX) is disposed between the data driving chip and data lines in the related art, and an output pin of the data driving chip may be coupled to multiple ones of the data lines through the multiplexer. However, such driving method may result in a problem of insufficient charging of the pixel unit.

SUMMARY

The present disclosure is directed to at least one of technical problems in the related art, and provides a driving method and a driving device for a display panel, and a display device.

The present disclosure provides a driving method for a display panel, the display panel including multiple data line groups and multiple multiplexers in one-to-one correspondence with the data line groups, each of the data line groups includes at least three data lines, and each of the multiplexers is configured to enable an input terminal of said each of the multiplexers to be electrically coupled to the data lines in the data line group, corresponding to said each of the multiplexers, successively in each line scanning period, and the driving method performs, for at least one of the data line groups, following steps:

acquiring data voltages to be output to the data lines in the data line group in a current line scanning period;

in response to that the data voltages to be output to the data line in the data line group are not completely equal to each other, successively outputting the data voltages to be output to the data lines to the input terminal of the multiplexer corresponding to the data line group according to a sequence from large to small or from small to large, and in response to that each of the data voltages is output to the input terminal of the multiplexer, controlling the multiplexer to electrically coupling the input terminal thereof with the data line to receive the data voltage.

In some implementations, the successively outputting the data voltages to be output to the data lines to the input terminal of the multiplexer according to the sequence from large to small or from small to large includes:

acquiring a maximum value and a minimum value of all the data voltages to be output to the data line group;

acquiring a difference value, as a first difference value, between the maximum value and a reference voltage, acquiring a difference value, as a second difference value, between the minimum value and the reference voltage;

comparing the first difference value with the second difference value, and in response to that the first difference value is less than the second difference value, successively outputting the data voltages to be output to the data lines to the input terminal of the multiplexer according to the sequence from large to small, and in response to that the first difference value is greater than the second difference value, successively outputting the data voltages to be output to the data lines to the input terminal of the multiplexer from small to large.

In some implementations, in response to that the current line scanning period is a line scanning period after a first line scanning period in a frame scanning period, the reference voltage is a data voltage last output to the input terminal of the multiplexer in a previous line scanning period.

In some implementations, the driving method further includes:

storing the data voltage which is finally output to the input terminal of the multiplexer in the current line scanning period.

Accordingly, an embodiment of the present disclosure further provides a driving device for a display panel, the display panel includes multiple data line groups and multiple multiplexers in one-to-one correspondence with the data line groups, each of the data line groups includes at least three data lines, and each of the multiplexers is configured to enable an input terminal of said each of the multiplexers to be electrically coupled to the data lines in the data line group, corresponding to said each of the multiplexers, successively in each line scanning period;

the driving device includes a data acquisition component, a voltage output component and a control component, the data acquisition component is configured to acquire data voltages to be output to the data lines in the data line group in a current line scanning period;

for at least one of the data line groups, the voltage output component is configured to, in response to that the data voltages for the data lines in the data line group are not completely equal to each other, successively output the data voltages to be output to the data lines to the input terminal of the multiplexer in a sequence from large to small or from small to large;

the control component is configured, in response to that the voltage output component outputs each of the data voltages to the input terminal of the multiplexer, to control the input terminal of the multiplexer to be electrically coupled to the data line to receive the data voltage.

In some implementations, the voltage output component includes:

an extreme value acquisition element configured to obtain a maximum value and a minimum value of all the data voltages to be output to the data line group;

a difference value acquisition element configured to acquire a difference value, as a first difference value, between the maximum value and a reference voltage; acquiring a difference value, as a second difference value, between the minimum value and the reference voltage;

a comparison element configured to compare the first difference value with the second difference value;

an output element configured to successively output the data voltages to be output to the data lines to the input terminal of the multiplexer in the sequence from large to small in response to that the first difference value is less than the second difference value, and successively output the data voltages to be output to the data lines to the input terminal of the multiplexer in the sequence from small to large in response to that the first difference value is greater than the second difference value.

In some implementations, in response to that the current line scanning period is a line scanning period after a first line scanning period in a frame scanning period, the reference voltage is a data voltage last output to the input terminal of the multiplexer in a previous line scanning period.

In some implementations, the driving device further comprises:

a storage component configured to store the data voltage which is last output by the voltage output component in the current line scanning period.

In some implementations, the multiplexer includes a plurality of selecting elements, the selecting elements of the multiplexer correspond to the data lines in the data line group corresponding to the multiplexer in one-to-one correspondence mode, and each of the selecting elements is configured to electrically couple the data line corresponding to said each of the selecting elements to the input terminal of the multiplexer under control of a signal at a first level and electrically decouple the data line corresponding to said each of the selecting elements from the input terminal of the multiplexer under control of a signal at a second level;

the control component is coupled to a plurality of clock signal terminals, and a number of the clock signal terminals is the same as that of the data lines in each of the data line groups; each of the clock signal terminals provides a clock signal which is switched between the first level and the second level, and in each line scanning period, signals of the clock signal terminals successively reach the first level; the control component is configured, in response to that the voltage output component outputs each of the data voltages to the input terminal of the multiplexer, to transmit an effective signal of one of the clock signal terminals to the selecting element corresponding to the data line to receive the data voltage, so that the selecting element enables the input terminal of the multiplexer to be electrically coupled to the data line to receive the data voltage.

In some implementations, the control component includes a plurality of switching devices, the selecting elements are coupled to the clock signal terminals through the switching devices in one-to-one correspondence mode, each of the switching devices is correspondingly coupled to a control signal line, and each of the switching devices is configured to electrically couple the selecting element to the clock signal terminal, which are coupled to the switching device, under control of the control signal line, or decouple the selecting element from the clock signal terminal, which are coupled to the switching device, under control of the control signal line.

In some implementations, each of the switching devices includes a switching transistor, a control electrode of the switching transistor is coupled to the control signal line, a first electrode of the switching transistor is coupled to the selecting element, and a second electrode of the switching transistor is connected to the clock signal terminal.

Correspondingly, an embodiment of the present disclosure provides a display device, including: a display panel and the driving device mentioned above, the display panel includes a plurality of data line groups and a plurality of multiplexers in one-to-one correspondence with the data line groups, each of the data line groups includes at least three data lines, and each of the multiplexers is configured to enable an input terminal of said each of the multiplexers to be electrically coupled to the data lines in the data line group, corresponding to said each of the multiplexers, successively in each line scanning period.

In some implementations, each of the data line groups includes three data lines.

In some implementations, each of the multiplexers includes selecting elements coupled between the input terminal of said each of the multiplexers and the data lines in the data line group corresponding to said each of the multiplexers, and each of the selecting elements is configured to electrically couple the data line corresponding to the selecting element to the input terminal of the multiplexer under control of a signal at a first level and electrically decouple the data line corresponding to the selecting element from the input terminal of the multiplexer under control of a signal at a second level.

In some implementations, each of the selecting elements includes a selecting transistor, a control electrode of the selecting transistor is coupled to the driving device, a first electrode of the selecting transistor is coupled to the input terminal of the multiplexer, and a second electrode of the selecting transistor is coupled to the data line corresponding to the selecting element.

DESCRIPTION OF DRAWINGS

The accompanying drawings, which are included to provide a further understanding of the present disclosure and are incorporated in and constitute a part of the specification, illustrate embodiments of the present disclosure and together with the description serve to explain the present disclosure, but do not constitute a limitation of the present disclosure. In the drawings.

DESCRIPTION OF EMBODIMENTS

Embodiments of the present disclosure are described in detail below by referring to the accompanying drawings. It should be understood that implementations described below are only used for illustrating and explaining the present disclosure, but the present disclosure is not limited thereto.

Figure 1:
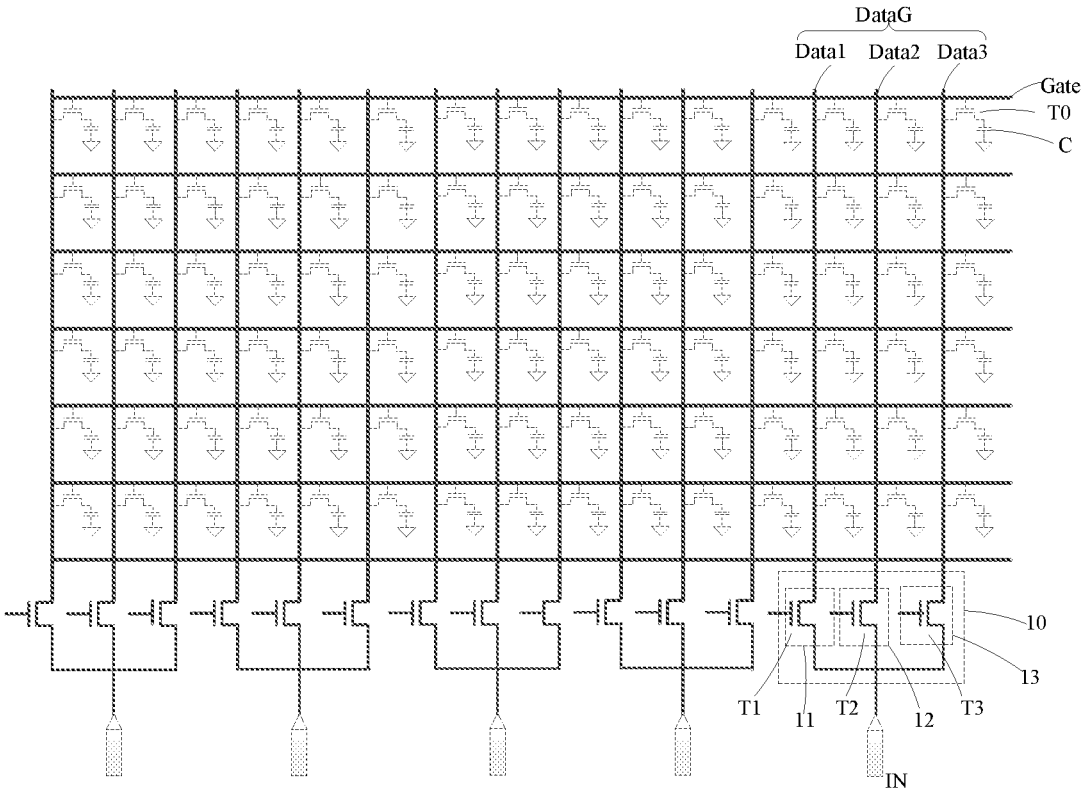
FIG. 1 is a schematic structural diagram of a display panel according to an embodiment of the present disclosure.
Figure 2:
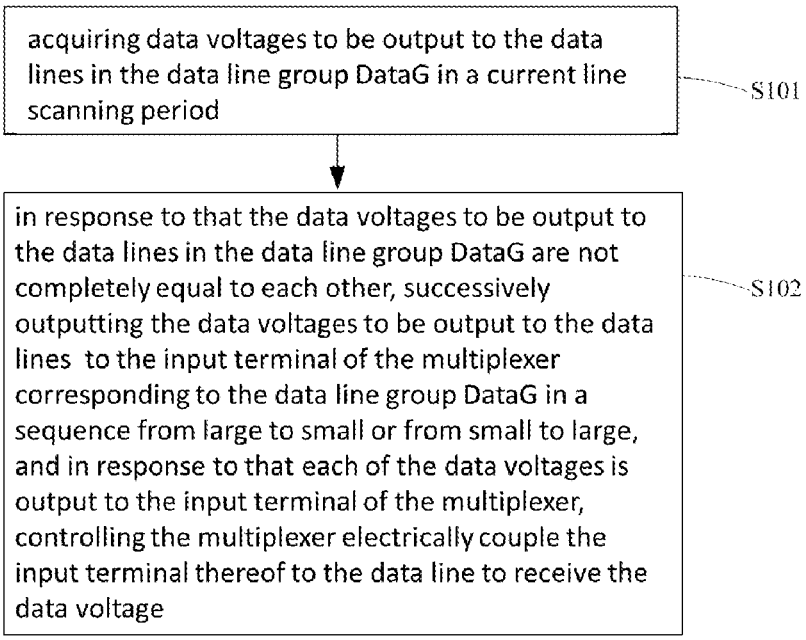
FIG. 2 is a flowchart of a driving method for a display panel according to an embodiment of the present disclosure.

An embodiment of the present disclosure provides a driving method for a display panel, FIG. 1 is a schematic structural diagram of the display panel according to the embodiment of the present disclosure, FIG. 2 is a flowchart of the driving method for the display panel according to the embodiment of the present disclosure, and as shown in FIG. 1, the display panel includes a plurality of data line groups DataG and a plurality of multiplexers 10 in one-to-one correspondence with the data line groups, and each of the data line groups DataG includes at least three data lines Data1 to Data3. Each of the multiplexers 10 has an input terminal IN and a plurality of output terminals, the input terminal IN of the multiplexer 10 may be coupled to an output terminal of a data driving chip; the output terminals of the multiplexer 10 are coupled to the data lines in the data line group DataG corresponding to the multiplexer 10 in a one-to-one correspondence mode. The Multiplexer 10 is configured to electrically couple the input terminal IN to the output terminals successively in each line scanning period, so that the input terminal IN is electrically coupled to each of the data lines in the data line group DataG successively, and data voltages received by the input terminal IN of the Multiplexer 10 are transmitted to the data lines Data1 to Data3 successively.

As shown in FIG. 1, the display panel may further include a plurality of gate lines Gate, and the gate lines Gate and the data lines intersect with each other, thereby a plurality of pixel units are defined in a display area, and each of the pixel units is provided with a thin film transistor T0 and a capacitor C. A gate electrode of the thin film transistor T0 is coupled to the gate line Gate, a first electrode of the thin film transistor T0 is coupled to the data line, and a second electrode of the thin film transistor T0 is coupled to a pixel electrode (e.g., an electrode plate of the capacitor C).

It should be noted that the "line scanning period" is a period during which the gate line receives a scanning signal. For example, a first line scanning period for displaying each frame of image is a period during which a first gate line receives the scanning signal, and a second line scanning period for displaying each frame of image is a period during which a second gate line receives the scanning signal. When the gate line Gate receives the scanning signal, the thin film transistor T0 in the pixel unit of a corresponding row is turned on, thereby transmitting a data voltage to the pixel electrode when the corresponding data line receives the data voltage.

As shown in FIG. 2, the driving method provided in the embodiment of the present disclosure includes the following steps S101 and S102 for at least one of the data line groups.

At step S101, data voltages to be output to the data lines in the data line group DataG in a current line scanning period are acquired.

The data voltages to be output to the data lines may be determined according to image information of an image to be displayed.

At step S102, when the data voltages to be output to the data lines in the data line group DataG are not completely equal to each other, the data voltages to be output to the data lines are successively output to the input terminal of the multiplexer corresponding to the data line group DataG in a sequence from large to small or from small to large, and in response to that each of the data voltages is output to the input terminal IN of the multiplexer 10, the multiplexer 10 is controlled to electrically couple the input terminal IN thereof to the data line to receive the data voltage.

It should be understood that the data voltages to be output to the data lines in the data line group DataG being not completely equal to each other means that the data voltage to be output to at least one of the data lines in the data line group DataG is different from the data voltages to be output to the other ones of the data lines in the data line group DataG.

It should be further noted that, in the embodiment of the present disclosure, the driving method is described by taking one line scanning period as an example, and in fact, steps S101 and S102 are performed in each line scanning period.

Figure 3A:
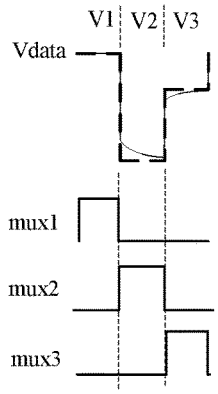
FIG. 3*a* is a driving timing diagram of a data line group in a current line scanning period according to a comparative example.
Figure 3B:
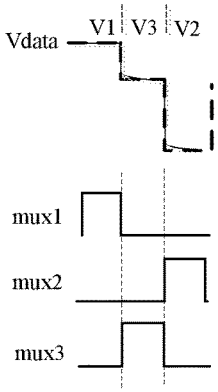
FIG. 3*b* is a driving timing diagram of a data line group in a current line scanning period according to an embodiment of the present disclosure.

Taking a driving timing of one data line group in the current line scanning period as an example, FIG. 3*a* is a driving timing diagram of one data line group in the current line scanning period according to a comparative example, and FIG. 3*b* is a driving timing diagram of one data line group in the current line scanning period according to the embodiment of the present disclosure. The data line group includes three data lines Date 1 to Date3, and the data voltages to be received by the three data lines Date1 to Date3 in the current line scanning period are respectively V1, V2 and V3. As shown in FIGS. 3*a* and 3*b*, Vdata is a data voltage supplied to the input terminal IN of the multiplexer 10, and mux1 is a control signal for controlling the input terminal of the multiplexer 10 to be electrically coupled to or decoupled from a first data line Data1 in the data line group DateG; when mux1 is at high level, the input terminal of the multiplexer 10 is controlled to be electrically coupled to the first data line Data1 in the data line group DateG; mux2 is a control signal for controlling the input terminal of the multiplexer 10 to be electrically coupled to or decoupled from a second data line Data2 in the data line group DateG; when mux2 is at high level, the input terminal of the multiplexer 10 is controlled to be coupled to the second data line Data2 in the data line group DateG; mux3 is a control signal for controlling the input terminal of the Multiplexer 10 to be electrically coupled to or decoupled from a third data line Data3 in the data line group; when mux3 is at high level, the input terminal of the multiplexer 10 is controlled to be electrically coupled to the third data line Data3 in the data line group DataG.

As shown in FIGS. 3*a* and 3*b*, the output terminal of the data driving chip needs to output the data voltage to the input terminal IN of the multiplexer 10 three times in each line scanning period, resulting in a short time for charging the pixel unit each time. As shown in FIGS. 3*a* and 3*b*, the solid line represents the data voltage actually received by the pixel unit. As shown in FIG. 3*a*, in the current line scanning period, mux1, mux2 and mux3 successively reach a high level, and the input terminal of the multiplexer 10 is successively electrically coupled to the first data line Data1, the second data line Data2 and the third data line Data3. Since a voltage difference between V1 and V2 and a voltage difference between V2 and V3 both are relative large, it is difficult for a voltage charged in the pixel unit to reach an ideal voltage, and since a relative large jump voltage difference exists between voltages supplied to the input terminal of the multiplexer 10, a relative large driving power consumption is resulted.

In the embodiment of the present disclosure, as shown in FIG. 3*b*, the data voltage supplied to the input terminal of the multiplexer 10 is successively changed from large to small or from small to large in each line scanning period, resulting in a reduced jump amount of the data voltage at the input terminal of the multiplexer 10, thereby improving the phenomenon of insufficient charging of the pixel unit and reducing the driving power consumption.

Figure 4:
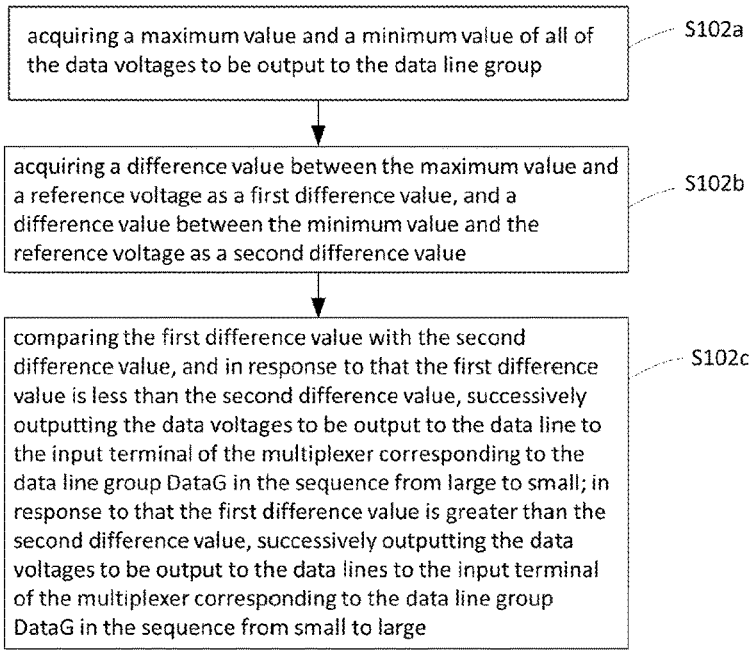
FIG. 4 is a schematic diagram of an alternative implementation manner of step S102 according to an embodiment of the present disclosure.

FIG. 4 is a schematic diagram of an alternative implementation manner of step S102 according to the embodiment of the present disclosure, and as shown in FIG. 4, step S102 includes the following sub-steps S102*a* to S102*c*.

At sub-step 102*a*, a maximum value and a minimum value of all of the data voltages to be output to the data line group DataG are acquired.

At sub-step 102*b*, a difference value between the maximum value and a reference voltage is acquired as a first difference value, and a difference value between the minimum value and the reference voltage is acquired as a second difference value.

The reference voltage may be predetermined. For example, the maximum value and the minimum value that the data voltages can usually reach may be counted in advance, and an average value of the maximum value and the minimum value may be used as the reference voltage.

In some implementations, if the current line scanning period is a line scanning period after a first line scanning period in a frame scanning period, the data voltage last output to the input terminal of the multiplexer 10 in a previous line scanning period is used as the reference voltage in step 102*b*. If the current line scanning period is the first line scanning period in the fame scanning period, the reference voltage may be set to a preset value, for example, 0V.

The frame scanning period is a stage of displaying a frame of image.

At step 102*c*, the first difference value is compared with the second difference value, and when the first difference value is less than the second difference value, the data voltages to be output to the data lines are successively output to the input terminal of the multiplexer 10 corresponding to the data line group DataG in the sequence from large to small; when the first difference value is greater than the second difference value, the data voltages to be output to the data lines are successively output to the input terminal of the multiplexer 10 corresponding to the data line group DataG in the sequence from small to large.

For example, in the previous line scanning period, the data voltage last output to the input terminal of the multiplexer 10 is 1.5V; in the current line scanning period, the data voltages to be output to the three data lines Data1 to Data3 in the data line group DataG are 2V, 1.3V and 2.5V respectively, and the data voltages of 1.3V, 2V and 2.5V are output to the input terminal IN of the multiplexer 10 in the sequence from small to large, so that a jump amount of the data voltage at the input terminal IN of the multiplexer 10 in two adjacent line scanning periods is reduced, the phenomenon of insufficient charging of the pixel unit is further improved, and the driving power consumption is further reduced.

It is to be understood that when the first difference value is equal to the second difference value, it indicates that the data voltages to be output to the data lines in the data line group DataG are the same, and thus, the data voltages may be output to the data lines in the data line group DataG in any order.

Figure 5A:
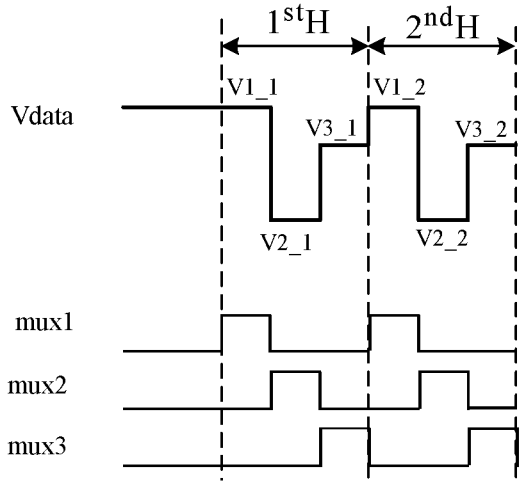
FIG. 5*a* is a timing diagram of data voltages of a data line group in two adjacent line scanning periods according to a comparative example.
Figure 5B:
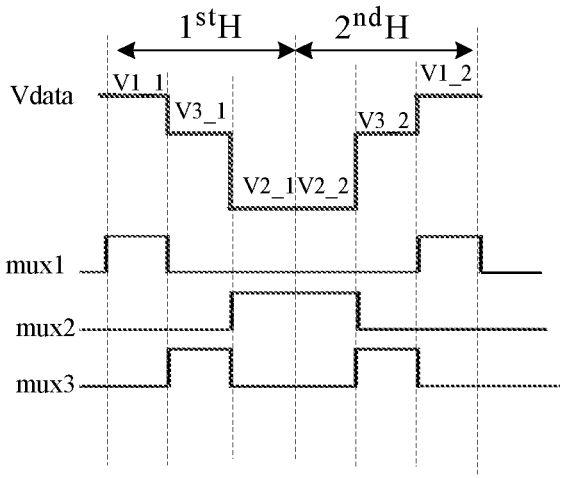
FIG. 5*b* is a timing diagram of data voltages in two adjacent line scanning periods according to an embodiment of the present disclosure.

FIG. 5*a* is a timing diagram of data voltages of one data line group in two adjacent line scanning periods according to a comparative example, and FIG. 5*b* is a timing diagram of data voltages of one data line group in two adjacent line scanning periods according to the embodiment of the present disclosure. In the $n^{th}$ line scanning period, the data voltages to be output to the three data lines Data1 to Data3 in the data line group DataG are respectively V1_1, V2_1 and V3_1; in the $(n+1)^{th}$ line scanning period, the data voltages to be output to the three data lines Data1 to Data3 are respectively V1_2, V2_2 and V3_2, and V1_1>V3_1>V2_1, V1_2>V3_2>V2_2, V2_2=V2_1. In the comparative example, the data voltages V1_1, V2_1, V3_1 are successively supplied to the input terminal IN of the multiplexer 10 in the $n^{th}$ line scanning period; when the data voltage V1_1 is input, the input terminal IN of the multiplexer 10 is controlled to be electrically coupled to the data line Data1, when the data voltage V2_1 is input, the input terminal IN of the multiplexer 10 is controlled to be electrically coupled to the data line Data2, and when the data voltage V3_1 is input, the input terminal IN of the multiplexer 10 is controlled to be electrically coupled to the data line Data 3. In the $(n+1)^{th}$ line scanning period, the data voltages V1_2, V2_2 and V3_2 are successively input to the input terminal IN of the multiplexer 10, and when the data voltage V1_2 is input, the input terminal IN of the multiplexer 10 is controlled to be electrically coupled to the data line Data1, when the data voltage V2_2 is input, the input terminal IN of the multiplexer 10 is controlled to be electrically coupled to the data line Data2, and when the data voltage V3_2 is input, the input terminal IN of the multiplexer 10 is controlled to be electrically coupled to the data line Data3. In such case, a total amount of jump amount of the data voltage at the input terminal IN of the multiplexer 10 in the two line scanning periods is |V1_1-V2_1|+|V2_1-V3_1|+|V3_1-V1_2|+|V1_2-V2_2|+|V3_2_V2_2|.

In the embodiment of the present disclosure, the data voltages V1_1, V3_1, and V2_1 are successively supplied to the input terminal IN of the multiplexer 10 in the $n^{th}$ line scanning period, and the data voltages V2_2, V3_2, and V1_2 are successively supplied to the input terminal IN of the multiplexer 10 in the $(n+1)^{th}$ line scanning period, and thus the total amount of jump amount of the data voltage at the input terminal IN of the multiplexer 10 in the two line scanning periods is |V1_1-V3_1|+|V3_1-V2_1|+|V2_2-V3_2|+|V3_2-V1_2|, which is significantly less than that in the comparative example. Therefore, compared to the comparative example, the driving method of the embodiment of the present disclosure can effectively reduce the total amount of jump amount of the data voltage at the input terminal IN of the multiplexer 10, that is, reduce a total amount of jump amount of a data voltage at the output terminal of the data driving chip, thereby improving the phenomenon of insufficient charging of the pixel unit and reducing the driving power consumption.

In some implementations, the driving method further includes: storing the data voltage last output to the input terminal IN of the multiplexer 10 in the current line scanning period, thereby facilitating acquiring the reference voltage in the next line scanning period.

It should be noted that, in the embodiment of the present disclosure, the driving process of each data line group in a part of the data line groups may be performed according to the process including step S101 to step S102, or the driving process of each of the data line groups of the display panel may be performed according to the process including step S101 to step S102, as long as the total amount of jump amount of the data voltages for all the data lines is reduced compared with the driving method shown in FIG. 5*a*.

An embodiment of the present disclosure further provides a driving device for a display panel, and as shown in FIG. 1, the display panel includes a plurality of data line groups DataG and a plurality of multiplexers 10 in one-to-one correspondence with the data line groups DataG, each of the data line groups DataG includes at least three data lines Data1 to Data3, and each of the multiplexers 10 is configured to electrically couple the input terminals IN of the multiplexer 10 to the data lines in the data line group DataG corresponding to the multiplexer 10 successively in each line scanning period. In some implementations, each of the multiplexers 10 includes a plurality of selecting elements 11 to 13, the selecting elements 11 to 13 of the multiplexer 10 correspond to the data lines of the data line group DataG corresponding to the multiplexer 10 in one-to-one correspondence mode, and each of the selecting elements 11 to 13 are configured to electrically couple the data line corresponding to said each of the selecting elements 11 to 13 to the input terminal IN of the multiplexer 10 under control of a signal at a first level and electrically decouple the data line corresponding to said each of the selecting elements 11 to 13 from the input terminal IN of the multiplexer 10 under control of a signal at a second level. In some implementations, the first level is a high level and the second level is a low level.

The selecting element 11 may include a selecting transistor T1, the selecting element 12 may include a selecting transistor T2, and the selecting element 13 may include a selecting transistor T3. Control electrodes of the selecting transistors T1 to T3 are configured for receiving control signals at the first level or the second level, first electrodes of the selecting transistors T1 to T3 are coupled to the input terminal IN of the multiplexer 10, and second electrodes of the selecting transistors T1 to T3 are coupled to the data lines.

Figure 6:
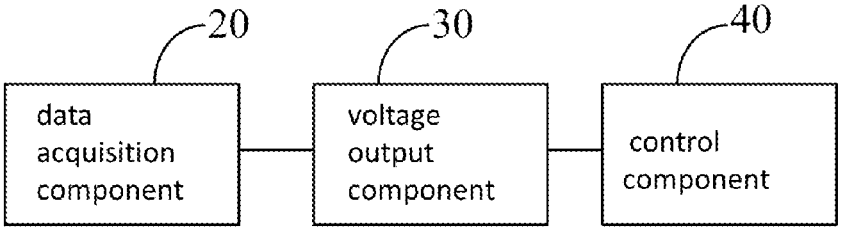
FIG. 6 is a schematic structural diagram of a driving device according to an embodiment of the present disclosure.

FIG. 6 is a schematic structural diagram of the driving device according to the embodiment of the present disclosure, and as shown in FIG. 6, the driving device includes: a data acquisition component 20, a voltage output component 30 and a control component 40.

The data acquisition component 20 is configured to acquire data voltages to be output to the data lines in the data line group in a current line scanning period.

For at least one data line group, the voltage output component 30 is configured, in response to that the data voltages to be output to the data lines in the data line group are not completely equal to each other, to output the data voltages to be output to the data lines in the data line group to the input terminal of the multiplexer 10 corresponding to the data line group in a sequence from large to small or from small to large.

The control component 40 is configured, in response to that the voltage output component 30 outputs each data voltage to the input terminal of the multiplexer 10, to control the input terminal of the multiplexer 10 to be electrically coupled to the data line to receive the data voltage.

In the embodiment of the present disclosure, the data voltages provided by the voltage output component 30 to the input terminal of the multiplexer 10 is changed successively from large to small or from small to large in each line scanning period, so that the total amount of jump amount of the data voltage at the input terminal of the multiplexer 10 in the line scanning period can be reduced, thereby improving the phenomenon of insufficient charging of the pixel unit and reducing the driving power consumption.

Figure 7:
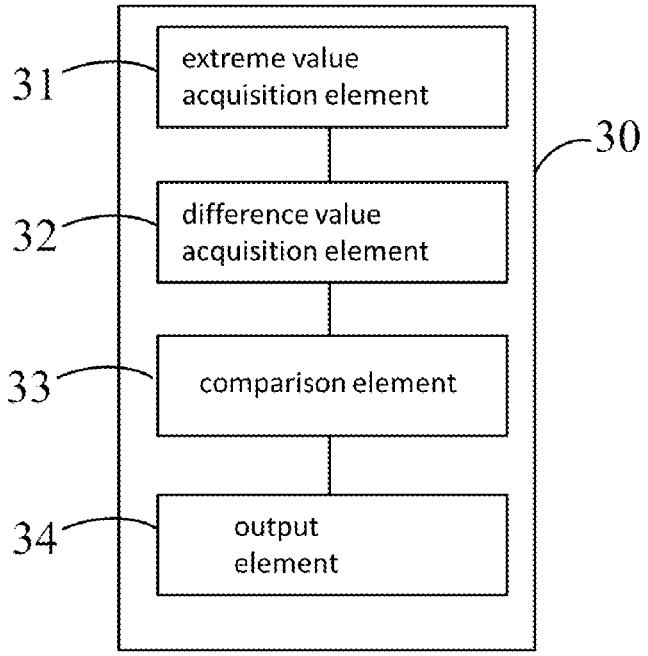
FIG. 7 is a schematic structural diagram of an alternative configuration of a voltage output component according to an embodiment of the present disclosure.

FIG. 7 is a schematic diagram of an alternative structure of the voltage output component provided in the embodiment of the present disclosure, and as shown in FIG. 7, in some implementations, the voltage output component 30 may include an extreme value acquisition element 31, a difference value acquisition element 32, a comparison element 33, and an output element 34.

The extreme value acquisition element 31 is configured to acquire the maximum value and the minimum value of all the data voltages to be output to the data line group DataG.

The difference acquisition element 32 is configured to acquire a difference value between the maximum value and a reference voltage as a first difference value, and acquire a difference value between the minimum value and the reference voltage as a second difference value. In some implementations, if the current line scanning period is a line scanning period after a first line scanning period in a fame scanning period, the reference voltage is the data voltage last output to the input terminal IN of the multiplexer 10 in a previous line scanning period.

The comparison element 33 is configured to compare the first difference value with the second difference value.

The output element 34 is configured, in response to that the first difference value is less than the second difference value, to successively output the data voltages to be output to the data lines to the input terminal IN of the multiplexer 10, corresponding to the data lines, in the sequence from large to small, and in response to that the first difference value is greater than the second difference value, to successively output the data voltages to be output to the data lines to the input terminal IN of the multiplexer 10, corresponding to the data lines, in the sequence from small to large.

The output element 34 may be specifically a data driving chip.

Figure 8:
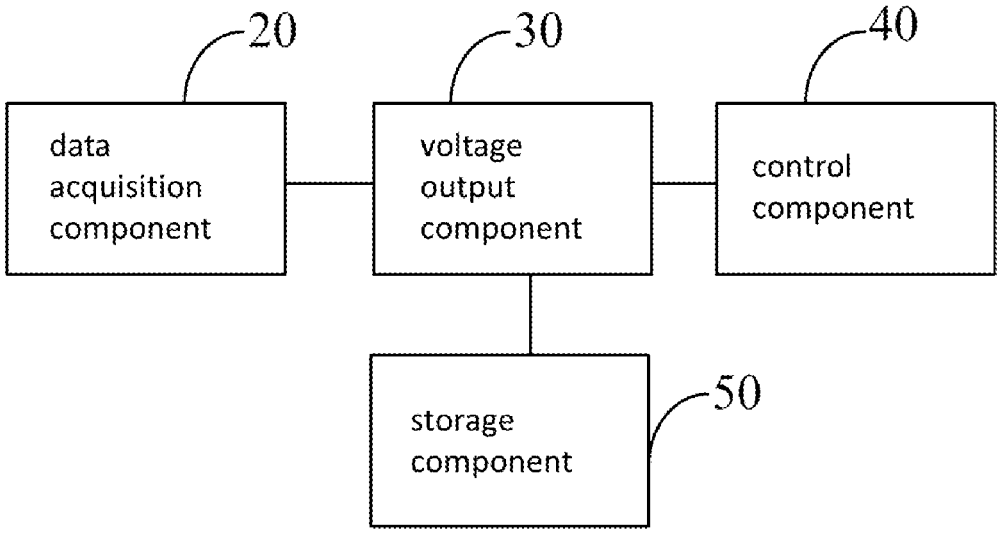
FIG. 8 is a schematic structural diagram of another driving device according to an embodiment of the present disclosure.

FIG. 8 is a schematic structural diagram of the driving device according to the embodiment of the present disclosure, and as shown in FIG. 8, in some implementations, the driving device further includes a storage component 50, and the storage component 50 is configured to store the data voltage last output by the voltage output component 30 in the current line scanning period.

Figure 9:
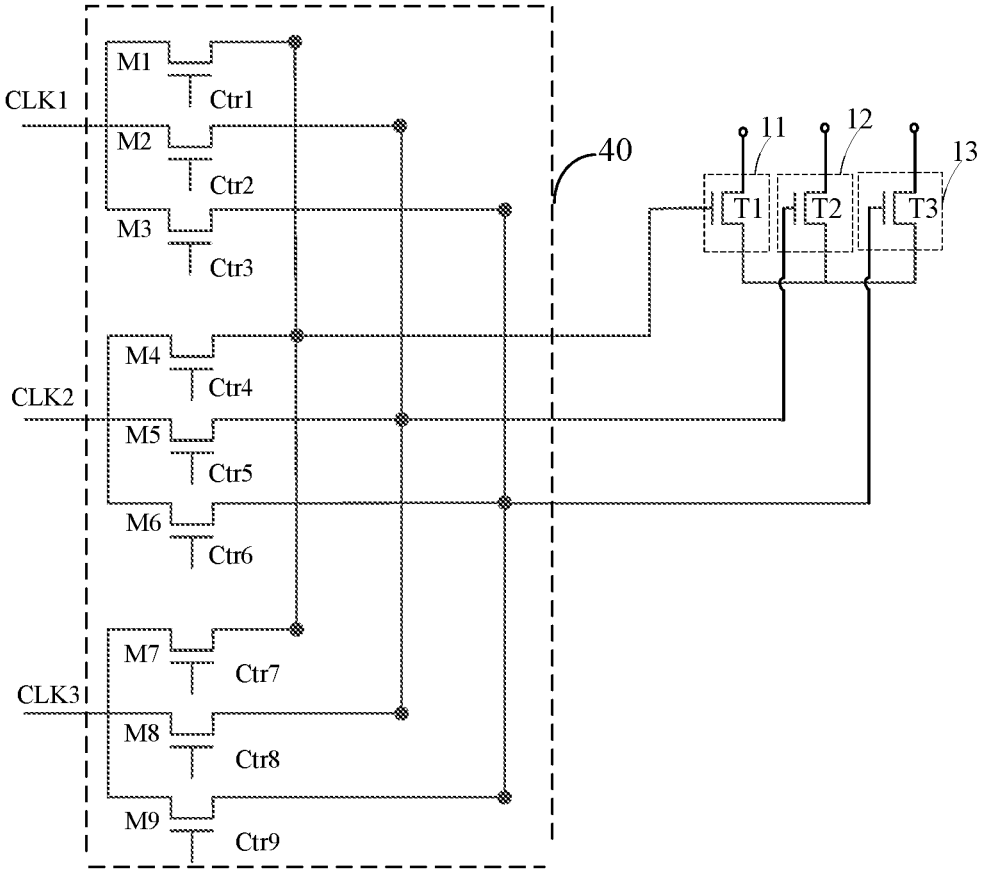
FIG. 9 is a schematic structural diagram of a control component according to an embodiment of the present disclosure.

FIG. 9 is a schematic structural diagram of the control component according to the embodiment of the present disclosure, and as shown in FIG. 9, the control component 40 is coupled to a plurality of clock signal terminals CLK1 to CLK3, and the number of the clock signal terminals CLK1 to CLK3 is the same as the number of the data lines in each data line group DataG; each of the clock signal terminals CLK1 to CLK3 provides a clock signal that switches between a first level and a second level, and signals of the clock signal terminals CLK1 to CLK3 successively reach the first level in each line scanning period. The control component 40 is specifically configured to: in response to that the voltage output component 30 outputs each data voltage to the input terminal of the multiplexer 10, transmit the signal at the first level at one of the clock signal terminals to the selecting element corresponding to the data line to receive the data voltage, so that the selecting element couples the input terminal of the multiplexer 10 to the data line to receive the data voltage.

In some implementations, the control component 40 may include a plurality of switching devices M1 to M9, each selecting element is coupled to each clock signal terminal through the switching device, each of the switching devices is correspondingly coupled to a control signal line (for example, as shown in FIG. 9, the switching device M1 is coupled to the control signal line Ctr1, the switching device M2 is coupled to the control signal line Ctr2, and the like), and each of the switching devices is configured to electrically couple the selecting element, coupled to the switching device, to the clock signal terminal, or electrically decouple the selecting element, coupled to the switching device, from the clock signal terminal, under control of the control signal line.

In some implementations, each of the switching devices may include a switching transistor, a control electrode of the switching transistor is coupled to the control signal line, a first electrode of the switching transistor is coupled to the selecting element, and a second electrode of the switching transistor is coupled to the clock signal terminal. The switching transistor may be an N-type transistor or a P-type transistor. When the switching transistor is the N-type transistor, in response to that a high level signal is provided to the switching transistor through the control signal line, the selecting element and the clock signal terminal, which are coupled to the switching transistor, can be controlled to be electrically coupled to each other, and when the switching transistor is the P-type transistor, in response to that a low level signal is supplied to the switching transistor through the control signal line, the selecting element and the clock signal terminal, which are coupled to the switching transistor, can be controlled to be electrically coupled to each other.

In the embodiment of the present disclosure, the switching device can electrically couple/decouple the selecting element to/from the clock signal terminal which are coupled to the switching device, under control of the control signal line, and thus, the data voltages to be output to the data line group DataG may be successively transmitted to the data lines to receive the data voltages in a sequence from large to small or from small to large under control of the control signal line according to timing of the clock signal terminals CLK1 to CLK3 outputting the signals at the first level and a sequence of the selecting elements 11 to 13 being turned on.

For example, as shown in FIG. 9, the switching devices are all N-type transistors, and on and off of the selecting element 11 are affected by the switching devices M1, M4, and M7. When the control signal line Ctr1 provides a high level signal and the control signal lines Ctr4 and Ctr7 provide low level signals, the switching device M1 is turned on, the switching devices M4 and M7 are turned off, and the signal of the clock signal terminal CLK1 is output to the selecting element 11, so that on and off of the selecting element 11 are controlled by the signal of the clock signal terminal CLK1. When the control signal lines Ctr1 and Ctr7 provide low level signals and the control signal line Ctr4 provides a high level signal, the switching devices M1 and M7 are turned off, the switching device M4 is turned on, and the signal of the clock signal terminal CLK2 is output to the selecting element 11, so that on and off of the selecting element 11 are controlled by the signal of the clock signal terminal CLK 2. When the control signal line Ctr7 provides a high level signal and the control signal lines Ctr1 and Ctr4 provide low level signals, the switching device M7 is turned on, the switching devices M1 and M4 are turned off, and the signal of the clock signal terminal CLK3 is output to the selecting element 11, so that on and off of the selecting element 11 are controlled by the signal of the clock signal terminal CLK3.

On and off of the selecting element 12 are affected by the switching devices M2, M5, and M8. When the control signal line Ctr2 provides a high level signal and the control signal lines Ctr5 and Ctr8 provide low level signals, the switching device M2 is turned on, the switching devices M5 and M8 are turned off, and the signal of the clock signal terminal CLK1 is output to the selecting element 12, so that on and off of the selecting element 12 are controlled by the signal of the clock signal terminal CLK1. When the control signal lines Ctr2 and Ctr8 provide low level signals and the control signal line Ctr5 provides a high level signal, the switching devices M2 and M8 are turned off, the switching device M5 is turned on, and the signal of the clock signal terminal CLK2 is output to the selecting element 12, so that on and off of the selecting element 12 is controlled by the signal of the clock signal terminal CLK2. When the control signal line Ctr8 provides a high level signal and the control signal lines Ctr2 and Ctr5 provide low level signals, the switching device M8 is turned on, the switching devices M2 and M5 are turned off, and the signal of the clock signal terminal CLK3 is output to the selecting element 12, so that on and off of the selecting element 12 are controlled by the signal of the clock signal terminal CLK3.

On and off of the selecting element 13 are affected by the switching devices M3, M6, and M9. When the control signal line Ctr3 provides a high level signal and the control signal lines Ctr6 and Ctr9 provide low level signals, the switching device M3 is turned on, the switching devices M6 and M9 are turned off, and the signal of the clock signal terminal CLK1 is output to the selecting element 13, so that on and off of the selecting element 13 is controlled by the signal of the clock signal terminal CLK1. When the control signal lines Ctr3 and Ctr9 provide low level signals and the control signal line Ctr6 provides a high level signal, the switching devices M3 and M9 are turned off, the switching device M6 is turned on, and the signal of the clock signal terminal CLK2 is output to the selecting element 13, so that on and off of the selecting element 13 are controlled by the signal of the clock signal terminal CLK2. When the control signal line Ctr9 provides a high level signal and the control signal lines Ctr3 and Ctr6 provide low level signals, the switching device M9 is turned on, the switching devices M3 and M6 are turned off, and the signal of the clock signal terminal CLK3 is output to the selecting element 13, so that on and off of the selecting element 13 are controlled by the signal of the clock signal terminal CLK3.

Figure 10:
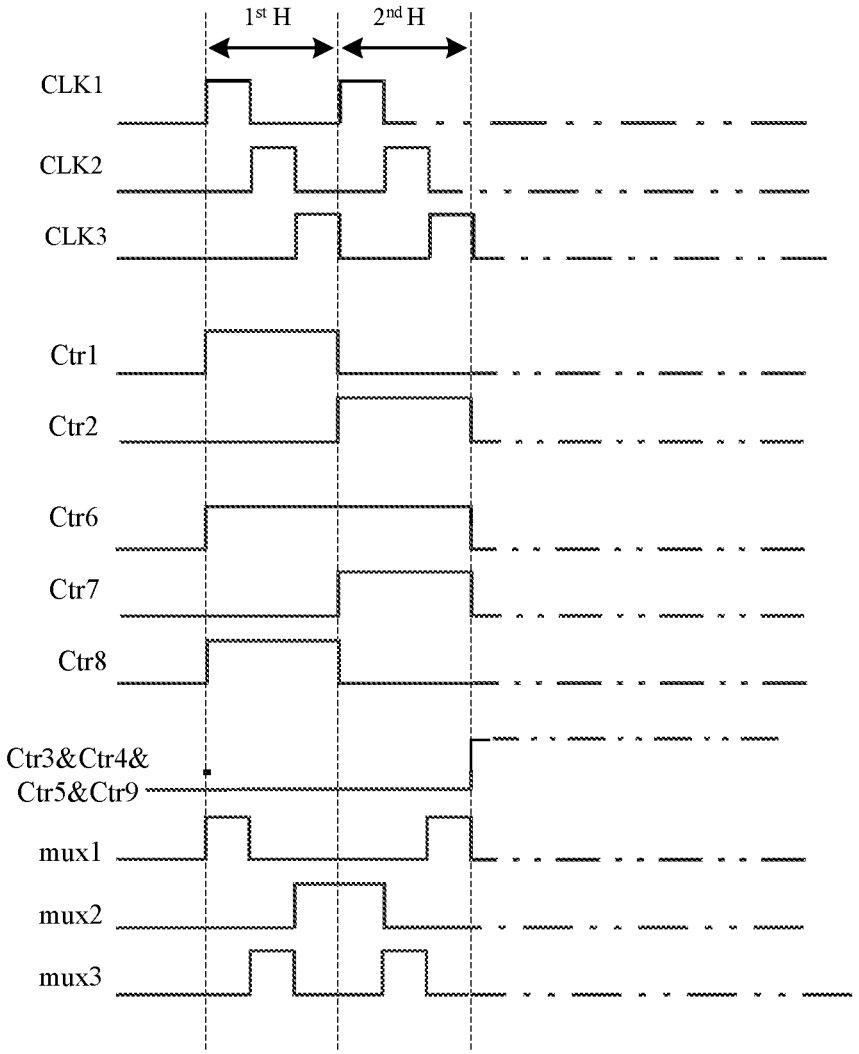
FIG. 10 is a timing diagram of supplying data voltages to a data line group according to a specific example of the present disclosure.

A specific example of supplying the data voltages to the data line group DataG including three data lines Data1, Data2, and Data3, and the switching transistors being the N-type transistors, is given below. In the first line scanning period $1^{st}$H, the data voltages to be received by the three data lines Data1, Data2 and Data3 are V1_1, V2_1 and V3_1, respectively, in the second line scanning period $2^{nd}$H, the data voltages to be received by the three data lines Data1, Data2 and Data3 are V1_2, V2_2 and V3_2, respectively, and so on, where V1_1>V3_1>V2_1, V1_2>V3_2>V2_2, V2_1=V2_2; the clock signal terminals CLK1, CLK2, and CLK3 successively output high level signals in each line scanning period. FIG. 10 is a timing diagram for providing the data voltages to the data line group according to a specific example of the present disclosure, where mux1, mux2, and mux3 in FIG. 10 respectively represent control signals for controlling on and off of the selecting elements 11 to 13, i.e., control signals respectively output to gate electrodes of the selecting transistors in the selecting elements 11 to 13.

As shown in FIG. 10, in the first line scanning period $1^{st}$H, a high level is supplied to the control signal line Ctr1, and low level signals are supplied to the control signal lines Ctr4 and Ctr7, so that the selecting element 11 receives the signal of the clock signal terminal CLK1; low level signals are supplied to the control signal lines Ctr2 and Ctr5, and a high level signal is supplied to the control signal line Ctr8, so that the selecting element 12 receives the signal of the clock signal terminal CLK 3; moreover, low level signals are supplied to the control signal lines Ctr3 and Ctr9, and a high level signal is supplied to the control signal line Ctr6, so that the selecting element 13 receives the signal of the clock signal terminal CLK2. Under the control as above, the input terminal IN of the multiplexer 10 is successively coupled to the data lines Data1, Data3, and Data2 electrically, and the data voltages V1_1, V3_1, and V2_1 are successively supplied to the input terminal IN of the multiplexer 10 in the first line scanning period $1^{st}$H, so that the data lines Data1, Data3, and Data2 successively receive the data voltages corresponding to the data lines respectively in the first line scanning period $1^{st}$H.

In the second line scanning period $2^{nd}$H, since V1_2>V3_2>V2_2 and V2_1=V2_2, the data voltages V2_2, V3_2 and V1_2 are successively output to the input terminal IN of the multiplexer 10 in the sequence from small to large. Furthermore, low level signals are supplied to the control signal lines Ctr1 and Ctr4, and a high level signal is supplied to the control signal line Ctr7, so that the selecting element 11 receives the signal of the clock signal terminal CLK3; a high level signal is supplied to the control signal line Ctr2, and low level signals are supplied to the control signal lines Ctr5 and Ctr8, so that the selecting element 12 receives the signal of the clock signal terminal CLK1; the control signal lines Ctr3 and Ctr9 are supplied with low level signals, and the control signal line Ctr6 is supplied with a high level signal, so that the selecting element MUX3 receives the signal of the clock signal terminal CLK2. Through the above control process, the input terminal IN of the multiplexer 10 is successively coupled to the data lines Data2, Data3, and Data1 electrically in the second line scanning period $2^{nd}$H, so that the data lines Data2, Data3, and Data1 successively receive the data voltages corresponding to the data lines respectively in the second line scanning period $2^{nd}$H.

It should be noted that each selecting element being coupled to each clock signal terminal through the switching device means that each selecting element is indirectly coupled to each clock signal terminal through the switching device. In some implementations, switching devices to which different selecting elements are coupled are different from each other, e.g., each multiplexer 10 includes three selecting elements, and for two of the multiplexers 10, the selecting elements are coupled to the clock signal terminals through the switching devices in one-to-one correspondence mode (i.e., each multiplexer 10 is coupled to nine switching devices), and the nine switching devices coupled to the first multiplexer 10 are different from the nine switching devices coupled to the second multiplexer 10. In such case, for any one data line group, the voltage output component 30 may be configured to: successively output the data voltages to be output to the data lines to the input terminal of the multiplexer 10 in the sequence from large to small or from small to large. That is, the driving process for each data line group DataG includes: successively outputting the data voltages to be output to the data lines to the input terminal of the corresponding multiplexer 10 in the sequence from large to small or from small to large; in response to that each data voltage is output to the input terminal of the multiplexer 10, controlling the multiplexer 10 to electrically couple the input terminal thereof with the data line to receive the data voltage.

In some implementations, in the multiplexers 10, the gate electrodes of the selecting transistors numbered the same are coupled together, that is, the gate electrodes of the selecting transistors of the first selecting elements in the multiplexers 10 are coupled together, the gate electrodes of the selecting transistors of the second selecting elements in the multiplexers 10 are coupled together, the gate electrodes of the selecting transistors of the third selecting elements in the multiplexers 10 are coupled together, and so on. In such case, the number of switching devices can be reduced, and since the order of the data lines in each data line group DataG being electrically coupled to the input terminal of the multiplexer 10 is fixed (for example, the order of the three data lines Data1, Data3, Data 2 in each data line group being electrically coupled to the input terminal of the multiplexer 10 is Data1, Data3 and Data2), the data voltages to be output to the data lines can be successively output to the input terminal of the multiplexer 10 in the sequence from large to small or from small to large only when each data line group (referred to as reference data line group) in a part of the data line groups DataG is driven; in response to that each data voltage is output to the input terminal of the multiplexer 10, the multiplexer 10 is controlled to electrically couple the input terminal of the multiplexer 10 to the data line to receive the data voltage; when each of the other data line groups DataG is driven, the data voltages to be respectively received by the data lines in the data line group DataG are successively output to the input terminal of the multiplexer 10 according to the order in which the data lines are electrically coupled to the input terminal of the multiplexer 10 successively. Which data line group being used as the reference data line group can be determined by calculation, as long as the charging effect of the pixel unit can be improved compared with that in the driving manner shown in FIG. 5*a*.

An embodiment of the present disclosure further provides a display device, which includes a display panel and the above driving device, and as shown in FIG. 1, the display panel includes a plurality of data line groups DataG and a plurality of multiplexers 10 in one-to-one correspondence with the data line groups DataG, each of the data line groups DataG includes at least three data lines, and each of the multiplexers 10 is configured to electrically couple the input terminal IN of the multiplexer 10 to the data lines in the data line group DataG corresponding to the multiplexer 10 successively in each line scanning period.

In the embodiment of the present disclosure, the number of data lines in the data line group DataG is not particularly limited, for example, each of the data line groups DataG includes three, six, twelve, or another number of data lines. In a specific implementation, each of the data line groups DataG includes three data lines.

In some implementations, each of the multiplexers 10 includes the selecting elements 11 to 13 coupled between the input terminal of the multiplexer 10 and each data line of the data line group DataG corresponding to the multiplexer 10, each of the selecting elements 11 to 13 is configured to electrically couple the data line corresponding to said each of the selecting elements 11 to 13 to the input terminal IN of the multiplexer 10 under control of a signal at a first level and to electrically decouple the data line corresponding to said each of the selecting elements 11 to 13 from the input terminal IN of the multiplexer 10 under control of a signal at a second level.

The selecting elements may specifically include selecting transistors (e.g., T1-T3 shown in FIG. 1), control electrodes of the selecting transistors are coupled to the driving device, first electrodes of the selecting transistors T1 to T3 are coupled to the input terminal of the multiplexer 10, and second electrodes of the selecting transistors T1 to T3 are coupled to the data lines corresponding thereto. The control electrodes of the selecting transistors T1 to T3 are the gate electrodes of the selecting transistors T1 to T3, and one of the first electrode and the second electrode of each of the selecting transistors T1 to T3 is a source electrode, and the other one is a drain electrode.

The selecting transistors may be N-type transistors or P-type transistors, and when the selecting transistors are the N-type transistors, the first level is a high level and the second level is a low level; when the selecting transistors are P-type transistors, the first level is a low level, and the second level is a high level.

It will be understood that the above embodiments are merely exemplary embodiments employed to illustrate the principles of the present disclosure, and the present disclosure is not limited thereto. It will be apparent to those skilled in the art that various changes and modifications can be made therein without departing from the spirit and scope of the disclosure, and these changes and modifications are to be considered within the scope of the present disclosure.

The invention claimed is:

1. A driving method for a display panel, the display panel comprises a plurality of data line groups and a plurality of multiplexers in one-to-one correspondence with the data line groups, each of the data line groups comprises at least three data lines, and each of the multiplexers is configured to enable an input terminal of said each of the multiplexers to be successively coupled to the data lines electrically in the data line group, corresponding to said each of the multiplexers, in each line scanning period, and for at least one of the data line groups, the driving method comprises:

acquiring data voltages to be output to the data lines in the data line group in a current line scanning period;

in response to that the data voltages to be output to the data lines in the data line group are not completely equal to each other, successively outputting the data voltages to be output to the data lines to the input terminal of the multiplexer corresponding to the data line group in a sequence from large to small or from small to large, and controlling the multiplexer to electrically couple the input terminal of the multiplexer to the data line to receive the data voltage in response to that each of the data voltages is output to the input terminal of the multiplexer.

2. The driving method according to claim 1, wherein the successively outputting the data voltages to be output to the data lines to the input terminal of the multiplexer in the sequence from large to small or from small to large comprises:

acquiring a maximum value and a minimum value of all the data voltages to be output to the data line group;

acquiring a difference value between the maximum value and a reference voltage as a first difference value; acquiring a difference value between the minimum value and the reference voltage as a second difference value;

comparing the first difference value with the second difference value, and in response to that the first difference value is less than the second difference value, successively outputting the data voltages to be output to the data lines to the input terminal of the multiplexer in the sequence from large to small; and in response to that the first difference value is greater than the second difference value, successively outputting the data voltages to be output to the data lines to the input terminal of the multiplexer in the sequence from small to large.

3. The driving method according to claim 2, wherein in response to that the current line scanning period is a line scanning period after a first line scanning period in a fame scanning period, the reference voltage is the data voltage last output to the input terminal of the multiplexer in a previous line scanning period.

4. The driving method according to claim 1, further comprising:

storing the data voltage last output to the input terminal of the multiplexer in the current line scanning period.

5. A driving device for a display panel, the display panel comprises a plurality of data line groups and a plurality of multiplexers in one-to-one correspondence with the data line groups, each of the data line groups comprises at least three data lines, and each of the multiplexers is configured to enable an input terminal of said each of the multiplexers to be successively coupled to the data lines electrically in the data line group, corresponding to said each of the multiplexers, in each line scanning period;

the driving device comprises a data acquisition component, a voltage output component and a control component, the data acquisition component is configured to acquire data voltages to be output to the data lines in the data line group in a current line scanning period;

for at least one of the data line groups, the voltage output component is configured to, in response to that the data voltages to be output to the data lines in the data line group are not completely equal to each other, successively output the data voltages to be output to the data lines to the input terminal of the multiplexer in a sequence from large to small or from small to large;

in response to that the voltage output component outputs each of the data voltages to the input terminal of the multiplexer, the control component is configured to control the input terminal of the multiplexer to be electrically coupled to the data line to receive the data voltage.

6. The driving device according to claim 5, wherein the voltage output component comprises:

an extreme value acquisition element configured to acquire a maximum value and a minimum value of all the data voltages to be output to the data line group;

a difference value acquisition element configured to acquire a difference value between the maximum value and a reference voltage as a first difference value, acquire a difference value between the minimum value and the reference voltage as a second difference value;

a comparison element configured to compare the first difference value with the second difference value;

an output element configured to successively output the data voltages to be output to the data lines to the input terminal of the multiplexer in the sequence from large to small in response to that the first difference value is less than the second difference value, and successively output the data voltages to be output to the data lines to the input terminal of the multiplexer in the sequence from small to large in response to that the first difference value is greater than the second difference value.

7. The driving device according to claim 6, wherein in response to that the current line scanning period is a line scanning period after a first line scanning period in a fame scanning period, the reference voltage is the data voltage last output to the input terminal of the multiplexer in a previous line scanning period.

8. The driving device according to claim 5, further comprises:

a storage component configured to store the data voltage last output by the voltage output component in the current line scanning period.

9. The driving device according to claim 5, wherein each of the multiplexers comprises a plurality of selecting elements, the selecting elements of each of the multiplexers correspond, in one-to-one correspondence mode, to the data lines of the data line group corresponding to said each of the multiplexers, and each of the selecting elements is configured to electrically couple the data line corresponding to said each of the selecting elements to the input terminal of the multiplexer under control of a signal at a first level and electrically decouple the data line corresponding to said each of the selecting elements from the input terminal of the multiplexer under control of a signal at a second level;

the control component is coupled to a plurality of clock signal terminals, and the number of the clock signal terminals is the same as that of the data lines in the data line group; each of the clock signal terminals provides a clock signal switching between the first level and the second level, and in each line scanning period, signals of the clock signal terminals successively reach the first level; in response to that the voltage output component outputs each of the data voltages to the input terminal of the multiplexer, the control component is configured to transmit an effective signal of one of the clock signal terminals to the selecting element corresponding to the data line to receive the data voltage, so that the selecting element enables the input terminal of the multiplexer to be electrically coupled to the data line to receive the data voltage.

10. The driving device according to claim 9, wherein the control component includes a plurality of switching devices, the selecting elements are coupled to the clock signal terminals through the switching devices in one-to-one correspondence mode, each of the switching devices is correspondingly coupled to a control signal line, and each of the switching devices is configured to electrically couple the selecting element to which the switching device is coupled to the clock signal terminal or electrically decouple the selecting element to which the switching device is coupled from the clock signal terminal under control of the control signal line.

11. The driving device according to claim 10, wherein each of the switching devices comprises a switching transistor having a control electrode coupled to the control signal line, a first electrode coupled to the selecting element, and a second electrode coupled to the clock signal terminal.

12. A display device, comprising a display panel and the driving device according to claim 5, the display panel comprises a plurality of data line groups and a plurality of multiplexers in one-to-one correspondence with the data line groups, each of the data line groups comprises at least three data lines, and each of the multiplexers is configured to enable an input terminal of said each of the multiplexers to be successively coupled to the data lines electrically in the data line group, corresponding to said each of the multiplexers, in each line scanning period.

13. The display device according to claim 12, wherein each of the data line groups comprises three of the data lines.

14. The display device according to claim 12, wherein each of the multiplexers comprises selecting elements coupled between the input terminal of said each of the multiplexers and the data lines of the data line group corresponding to said each of the multiplexers, each of the selecting elements is configured to electrically couple the data line corresponding to the selecting element to the input terminal of the multiplexer under control of a signal at a first level and electrically decouple the data line corresponding to the selecting element from the input terminal of the multiplexer under control of a signal at a second level.

15. The display device according to claim 14, wherein each of the selecting elements comprises a selecting transistor having a control electrode coupled to the driving device, a first electrode coupled to the input terminal of the multiplexer, and a second electrode coupled to the data line.

* * * * *